US008938842B2

(12) United States Patent
Hasegawa et al.

(10) Patent No.: US 8,938,842 B2
(45) **Date of Patent: *Jan. 27, 2015**

(54) CLEANING SHEET AND CLEANING TOOL

(75) Inventors: Satoshi Hasegawa, Kagawa (JP); Tomokazu Suda, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 3 days.

This patent is subject to a terminal disclaimer.

(21) Appl. No.: 13/876,226

(22) PCT Filed: Sep. 22, 2011

(86) PCT No.: PCT/JP2011/071708

§ 371 (c)(1),
(2), (4) Date: Jun. 10, 2013

(87) PCT Pub. No.: WO2012/043409

PCT Pub. Date: Apr. 5, 2012

(65) Prior Publication Data

US 2013/0247322 A1 Sep. 26, 2013

(30) Foreign Application Priority Data

Sep. 27, 2010 (JP) ..... 2010-215369

(51) Int. Cl.

| | |
|---|---|
| ***A47L 13/16*** | (2006.01) |
| ***A47L 13/256*** | (2006.01) |
| ***A47L 13/44*** | (2006.01) |
| ***A47L 13/20*** | (2006.01) |

(52) U.S. Cl.

CPC ..... *A47L 13/16* (2013.01); *A47L 13/256* (2013.01); *A47L 13/44* (2013.01); *A47L 13/20* (2013.01)

USPC ..... 15/228; 15/209.1; 15/231

(58) Field of Classification Search

USPC ..... 15/209.1, 228, 231, 246

See application file for complete search history.

(56) References Cited

U.S. PATENT DOCUMENTS

| | | | | |
|---|---|---|---|---|
| 7,516,510 | B2 * | 4/2009 | Tanaka | 15/228 |
| 2003/0045197 | A1 * | 3/2003 | Kakiuchi et al. | 442/403 |

(Continued)

FOREIGN PATENT DOCUMENTS

| | | | |
|---|---|---|---|
| EP | 1 642 523 | A2 | 4/2006 |
| JP | 2007020615 | A | 2/2007 |

(Continued)

OTHER PUBLICATIONS

International Search Report based on corresponding PCT application No. PCT/JP2011/071708 dated Dec. 27, 2011 (8 pgs).

(Continued)

*Primary Examiner* — Shay Karls

(74) *Attorney, Agent, or Firm* — Brinks Gilson & Lione

(57) ABSTRACT

A cleaning sheet that is attachable to a cleaning sheet-attaching component and is characterized in having a central part configuring a cleaning surface and at least one end provided on at least one side of the central part in a prescribed direction. The at least one end has a first part with a first elongation percentage and a second part with a higher elongation percentage than the first part. The second part is provided between the first part and the central part in the prescribed direction, and the sheet is configured so as to be detachably held on the cleaning sheet-attaching component at the boundary between the first part and the second part. Also configured is a cleaning implement provided with said cleaning sheet.

12 Claims, 9 Drawing Sheets

(56) References Cited

U.S. PATENT DOCUMENTS

| | | | |
|---|---|---|---|
| 2006/0064834 | A1 | 3/2006 | Tanaka |
| 2012/0311805 | A1 | 12/2012 | Hasegawa et al. |

FOREIGN PATENT DOCUMENTS

| | | | |
|---|---|---|---|
| JP | 2008-161592 | A | 7/2008 |
| JP | 2011-136149 | A1 | 7/2011 |
| WO | WO 2011/067977 | A | 6/2011 |

OTHER PUBLICATIONS

International Preliminary Report on Patentability and Written Opinion from corresponding PCT application No. PCT/JP2011/071708 dated Apr. 25, 2013 (13 pgs).

Chinese Office Action from corresponding Chinese application No. 201080054499.4 dated Jan. 13, 2014 (12 pgs).

European extended Search Report from corresponding European application No. 10834430.0 dated Apr. 8, 2014 (6 pgs).

* cited by examiner

CLEANING SHEET AND CLEANING TOOL

RELATED APPLICATIONS

This application is a 35 U.S.C. §371 national phase filing of International Patent Application No. PCT/JP2011/071708, filed Sep. 22, 2011, through which and to which priority is claimed under 35 U.S.C. §119 to Japanese Patent Application No. 2010-215369, filed Sep. 27, 2010.

BACKGROUND OF THE INVENTION

1. Field of the Invention

The invention relates to a cleaning sheet and a cleaning tool, and more particularly to a cleaning sheet and a cleaning tool which can be suitably used for wiping an object to be cleaned, such as floor.

2. Description of the Related Art

Various cleaning sheets for wiping an object to be cleaned are known. For example, Japanese non-examined laid-open Patent Publication No. 2007-20615 discloses a cleaning sheet having an inner layer sheet and outer layer sheets integrally formed with the inner layer sheet on both sides of the inner layer sheet. In use, the cleaning sheet can be attached to a cleaning sheet mounting member of a cleaning tool.

In this case, a central portion of the cleaning sheet is placed on a cleaning part of the cleaning sheet mounting member. Both ends of the cleaning sheet are pushed in through holding members of the cleaning sheet mounting member and held between the holding members. The known cleaning sheet has a loosely entangled portion in its central portion and a tightly entangled portion in its both end portions.

SUMMARY OF THE INVENTION

In operation of cleaning floor or other objects having a high frictional resistance, with a cleaning sheet attached to a cleaning sheet mounting member of a cleaning tool, a tensile stress acts upon the cleaning sheet in a direction opposite to the direction of movement of the cleaning sheet mounting member. In the known cleaning sheet, the loosely entangled portion is formed in its central portion, but each of the end portions of the sheet has a substantially uniform elongation rate across its entire region. Therefore, when a tensile stress acts upon the cleaning sheet during cleaning operation, if the end portions of the cleaning sheet has a lower elongation rate or higher rigidity, the end portions of the cleaning sheet easily become detached from the holding members. On the other hand, if the end portions of the cleaning sheet are designed to have a higher elongation rate or lower rigidity in order to prevent the cleaning sheet from becoming detached, the end portions of the cleaning sheet held by the holding members are easily damaged by tensile stress. Therefore, it is difficult to secure reliable holding of the cleaning sheet and resistance to damage in a balanced manner.

Accordingly, it is an object of the invention to provide a technique for improving usability of the cleaning sheet and the cleaning tool.

The above-described problem can be solved by the claimed invention. According to this invention, a cleaning sheet which can be attached to a cleaning sheet mounting member is provided. This cleaning sheet is preferably formed of non-woven fabric. The cleaning sheet according to this invention has a central portion forming a cleaning side and at least one end portion formed on at least one side of the central portion along one predetermined direction. The end portion may be formed along one direction on only one side of the central portion, or it may be formed on both sides of the central portion. The end portion has a first part having a predetermined first elongation rate and a second part having a predetermined second elongation rate higher than the first part. The second part is formed between the first part and the central portion along the above-described one direction. A boundary between the first and second parts is removably held by the cleaning sheet mounting member. It is essential for the boundary to be held at least in part.

The "elongation rate (mm/N) of the cleaning sheet" is a measure of stretchiness of the cleaning sheet. The higher the elongation rate, the stretchier the sheet.

Various methods can be used to change the elongation rates of the first and second parts. For example, a method of changing the number of thicknesses of the sheet elements in the first and second parts, a method of changing the entangled state of fibers in the first and second parts, or a method of changing the constitution of raw cotton in the first and second parts can be used.

With this construction, in this invention, when a tensile stress acts upon the cleaning sheet attached to the cleaning sheet mounting member during cleaning operation, the first portion having a lower elongation rate (less stretchy) is held caught by the cleaning sheet mounting member due to its own rigidity without being damaged by the tensile stress. On the other hand, the second part having a higher elongation rate (more stretchy) stretches and thus effectively absorbs the tensile stress. As a result, the cleaning sheet can be prevented from becoming detached from the cleaning sheet mounting member during cleaning operation.

In another embodiment of the invention, the elongation rates of the first and second parts are changed according to the number of thicknesses of the sheet elements in the first and second parts. In this case, the second part having a higher elongation rate may be formed by a single sheet element, or it may be formed by several thicknesses of sheet elements. The second part formed by a single sheet element can be referred to as the "second part having the sheet element in a single layer". Further, the first part having a lower elongation rate is formed by a larger number of thicknesses of sheet elements than the sheet elements of the second part. As a method of layering sheet elements, a method of overlaying different sheet elements one on another or a method of folding one sheet element can be used. The layered sheet elements are preferably bonded together. Various methods can be used as the bonding method.

In this embodiment, the first and second parts are different in the number of thicknesses of the sheet elements, so that it can be easy to visually check the boundary between the first and second parts. Thus, the operation of holding the boundary by the holding member is easily performed. Further, the cleaning sheet in which the end portion has the first and second parts having different elongation rates can be manufactured at lower cost.

In a further embodiment of the invention, the layered sheet elements in the first part of the end portion are bonded together by embossing. Preferably, the sheet elements containing thermoplastic fibers are overlaid one on another and bonded together by hot embossing. Various kinds of sheet elements can be used as the sheet elements containing thermoplastic fibers.

In this embodiment, the elongation rates of the first and second parts can be more easily changed.

In a further embodiment of the invention, the end portion has a third part having a lower elongation rate than the second part. The third part is formed between the second part and the central portion along the one direction. The third part may have the same elongation rate as the first part, or it may have a different elongation rate from the first part.

In this embodiment, with the construction in which the third part having a lower elongation rate than the second part is disposed on the central portion side of the second part, the strength of the central portion side can be maintained, while the cleaning sheet can be prevented from becoming detached from the cleaning sheet mounting member.

In a further embodiment of the invention, a cleaning tool having the cleaning sheet and the cleaning sheet mounting member as described above can be provided.

Further, in a further embodiment of the invention, the holding member has a plurality of elastic holding pieces which are opposed to each other, and the boundary of the cleaning sheet is pushed in through the holding member between the holding pieces and caught by the holding pieces. In this manner, the boundary is held by the holding member.

According to this invention, a cleaning sheet or a cleaning tool is provided which is improved in usability. Other objects, features and advantages of this invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide improved cleaning sheets or cleaning tools and components utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
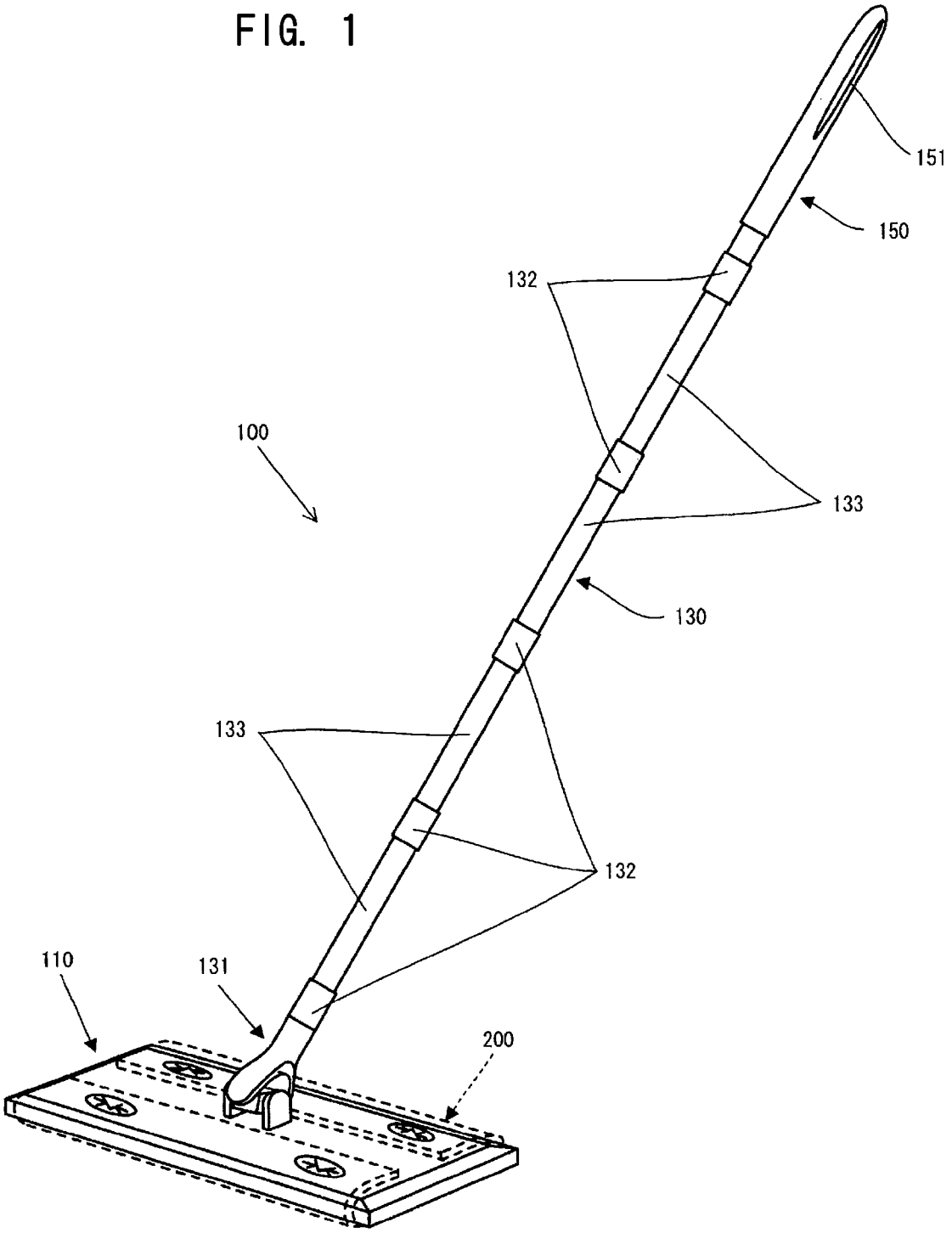
FIG. 1 is a perspective view showing an embodiment of a cleaning tool.

FIG. 1 is a perspective view showing an embodiment of a cleaning tool 100 according to this invention. The cleaning tool 100 of this embodiment has a head 100 to which a cleaning sheet 200 is attached, a pipe 130 and a handle 150. The pipe 130 is formed by coupling a plurality of pipe elements 133 via coupling mechanisms. Each of the coupling mechanisms includes, for example, a male coupling element provided on one end of one pipe element and a female coupling element provided on the other end of the other pipe element. The connection between the male coupling element and the female coupling element is covered with a cover 132. The one end of the pipe 130 is connected to the handle 150. The other end of the pipe 130 is connected to a connecting mechanism 131 provided on the head 110. In this embodiment, the head 110, the handle 150 and the pipe 130 are features that correspond to the "cleaning sheet mounting member", the "holding member" and the "connecting member for connecting the head and the handle", respectively, according to this invention. The number of the pipe elements 133 forming the pipe 130 can be appropriately selected. Further, the handle 150 may also be directly connected to the connecting mechanism 131 provided on the head 110.

Figure 2:
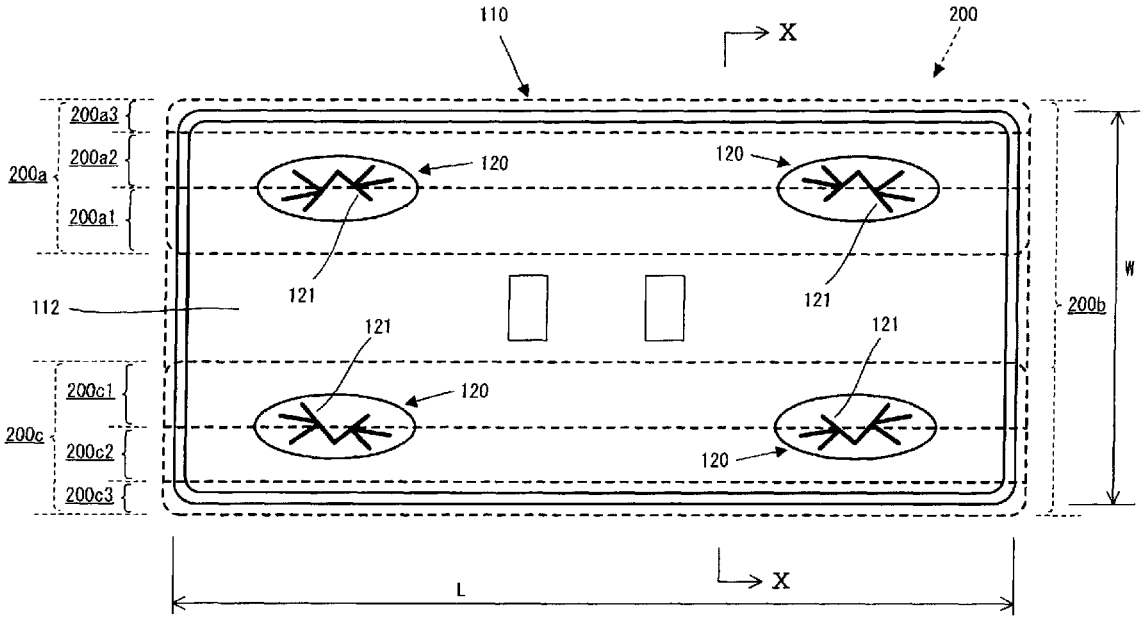
FIG. 2 is a plan view of a head.

The head 110 is shaped like a plate as shown in FIG. 2 and has an upper side 112 on which the connecting mechanism 131 is mounted, and a lower side (mounting side or cleaning part) 111 (see FIG. 10) opposite to the upper side 112. Holding members 120 are provided on the upper side 112. As shown in FIG. 2, each of the holding members 120 has a plurality of elastic holding pieces 121 which are defined by cuts.

Figure 5:
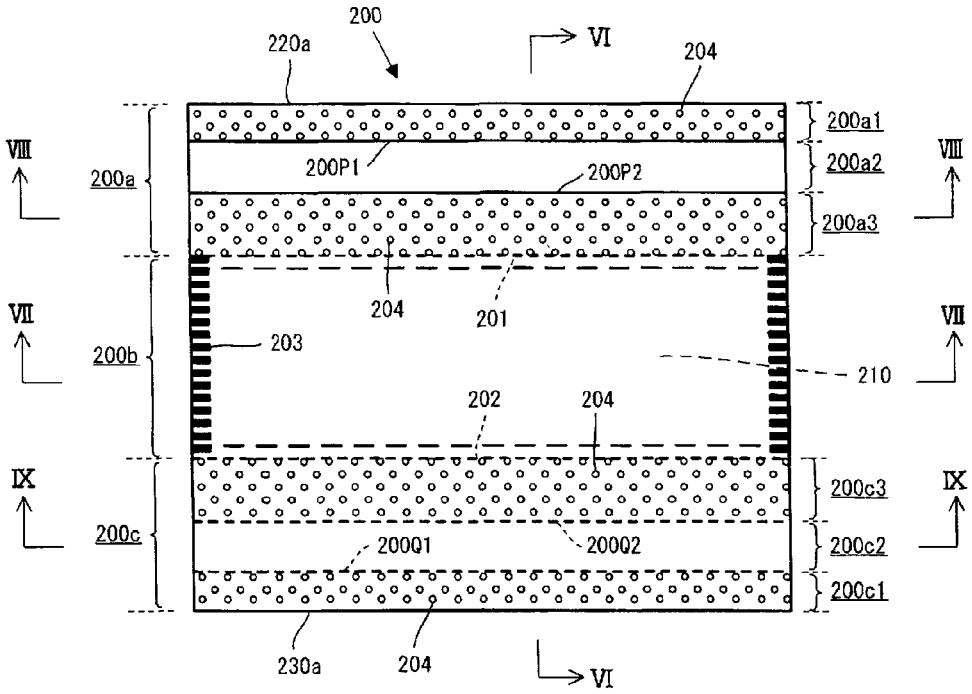
FIG. 5 shows the cleaning sheet 200 of the one embodiment in the unfolded state.
Figure 6:
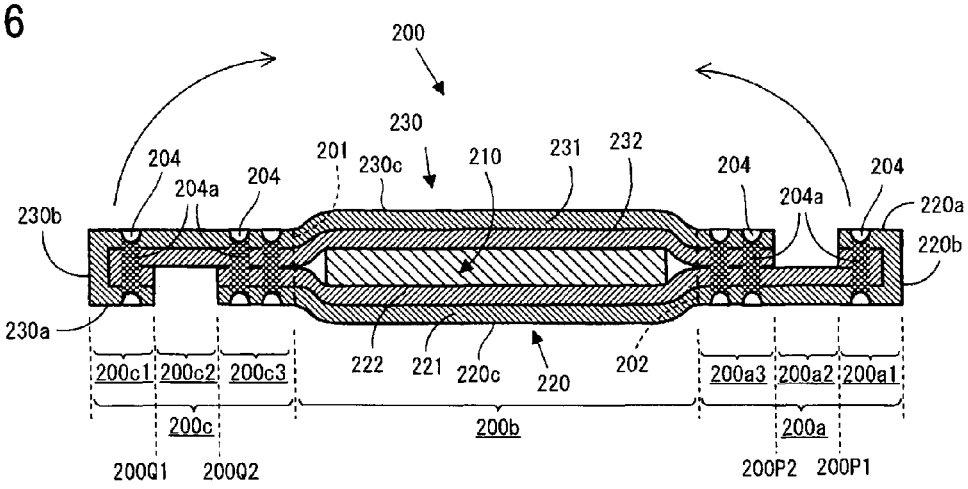
FIG. 6 is a sectional view taken along line VI-VI in FIG. 5.

As shown in FIGS. 5 and 6, the cleaning sheet 200 has a central portion **200*b* and end portions 200*a*, 200*c* provided on both sides of the central portion 200*b*, which will be described below in detail. The central portion 200*b* forms a main cleaning side of the cleaning sheet 200. Further, the end portion 200*c* forms a mounting portion which is mounted to the cleaning sheet mounting member (the head 110**).

The central portion **200*b* of the cleaning sheet 200 is placed to face the lower side (mounting side or cleaning part) 111 of the head 110, and the end portions 200*a*, 200*c* are placed on the upper side 112. Specifically, the cleaning sheet 200 is attached to the head 110 such that the head 110 is covered with the central portion 200*b* and the end portions 200*a*, 200*c*. In the state in which the end portions 200*a*, 200*c* of the cleaning sheet 200 are placed on the upper side 112, points of the end portions 200*a*, 200*c* which are located right above the holding members 120 (the holding pieces 121) are pushed in by user's fingers. Thus, the end portions 200*a*, 200*c* of the cleaning sheet 200 are caught in part and removably held between the adjacent holding pieces 121**.

In a cleaning operation using the cleaning tool 100 of this embodiment, generally, the head 110 is moved in a direction (the vertical direction as viewed in FIG. 2) transverse to a direction along a boundary (e.g. folding lines 201, 202 which are described below) between the central portion **200*b* and the end portion 200*a* or 200*c*. The head 110** can also be moved in the other directions.

An embodiment of a cleaning sheet 200 for use with the cleaning tool 100 of this embodiment is now explained.

Figure 4:
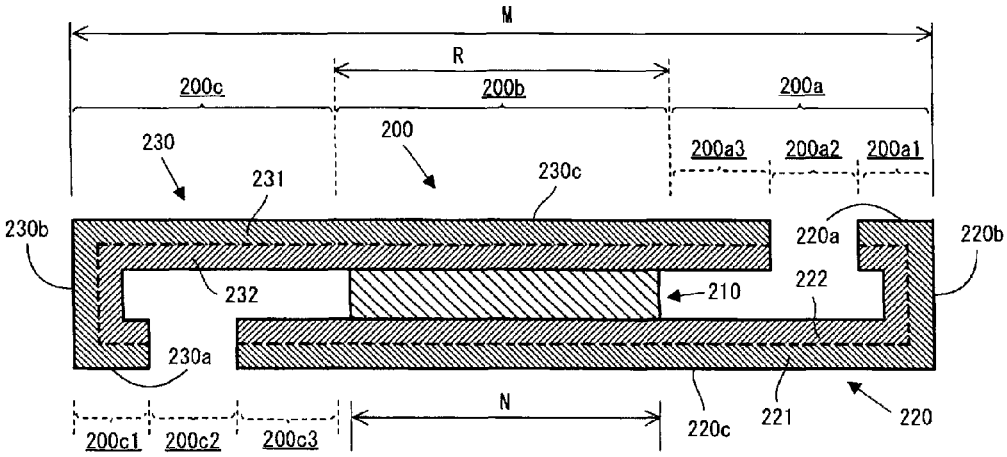
FIG. 4 is a sectional view taken along line IV-IV in FIG. 3.

As shown in FIG. 4, the cleaning sheet 200 has a three-layer structure having a single inner layer sheet 210 and single outer layer sheets 220, 230 disposed on the both sides of the inner layer sheet 210. The "cleaning sheet having a three-layer structure" here includes not only a cleaning sheet having a three-layer structure across its entire region, but a cleaning sheet having a three-layer structure in its main region (e.g. the central portion 200*b*) and not having a three-layer structure (e.g. having a single- or two-layer structure) in the other regions. This is also true for multi-layer structures other than the three-layer structure.

A hydrophilic nonwoven fabric sheet is used as the inner layer sheet 210. It is essential for the hydrophilic nonwoven fabric sheet to be hydrophilic as a whole, and the nonwoven fabric sheet may be formed of hydrophilic fibers and hydrophobic fibers. The hydrophilic fibers include rayon fibers, cotton fibers and pulp fibers. In this embodiment, the nonwoven fabric sheet is formed only of rayon fiber having high water absorbency and high moisture retentivity. The inner layer sheet 210 is a feature that corresponds to the "impregnated element", the "third nonwoven fabric sheet" or the "third sheet" according to this invention.

A nonwoven fabric sheet (spun lace nonwoven fabric sheet) manufactured by a water jet method (hydroentangling method) is used as the inner layer sheet 210. In the water jet method, spun lace nonwoven fabric of intertlaced fibers is manufactured by jetting high-pressure water, for example, onto a web of randomly arranged fibers from a plurality of nozzles disposed in an orientation transverse to the direction of feed of the web. In this embodiment, each of the nozzles for jetting high-pressure water has orifices having a diameter of 92 μm and continuously arranged over the width of 2.0 mm and such nozzles are arranged at intervals (orifice pitches) of 3.0 mm. By using such nozzles, air-through portions are formed in the spun lace nonwoven fabric, and a striped pattern appears on a finished spun lace nonwoven fabric. Thus, the specific volume ratio of the inner layer sheet 210 increases, so that the amount of impregnation (the amount of water retention) of the inner layer sheet 210 increases. The striped pattern is a feature that corresponds to the pattern of the "patterned indented surface of the inner layer sheet" according to this invention. The orifice pitch (interval of indentations) is set within the range of 2.0 to 10.0 mm, or more suitably, within the range of 2.0 to 3.0 mm. If the orifice pitch exceeds 10.0 mm, fibers are more loosely entangled with each other, so that fluff loss of fibers increases. Further, the strength decreases, so that it becomes difficult to form the nonwoven fabric sheet only of hydrophilic fibers. The inner layer sheet 210 may also include nonwoven fabric sheets manufactured by other methods, such as through-air bonding, spun bonding, thermal bonding, point bonding, melt blowing, chemical bonding and air-laid methods.

The basis weight of the inner layer sheet 210 is preferably set within the range of 40 to 70 gsm from the viewpoint of the amount of release of the cleaning solution, but it may exceed 70 gsm.

A hydrophobic nonwoven fabric sheet is used as the outer layer sheets 220, 230. It is essential for the hydrophobic nonwoven fabric sheet to be hydrophobic as a whole, and the nonwoven fabric sheet may be formed of hydrophilic fibers and hydrophobic fibers. The hydrophobic fibers include polyethylene terephthalate (PET) fibers, polypropylene (PP) fibers, polyethylene (PE) fibers and nylon fibers. One of the outer layer sheets 220, 230 and the other are features that correspond to the "first nonwoven fabric sheet" or the "first sheet" and the "second nonwoven fabric sheet" or the "second sheet", respectively, according to this invention.

Further, in this embodiment, a spun lace nonwoven fabric sheet manufactured by a water jet method (hydroentangling method) is used as the outer layer sheets 220, 230. Nonwoven fabric sheets manufactured by various other methods may also be used as the outer layer sheets 220, 230.

In the cleaning sheet 200 of this embodiment, as shown in FIG. 4, the outer layer sheet 220 (230) has a two-layer structure having a layer (inner layer) 222 (232) facing the inner layer sheet 210, and a layer (outer layer) 221 (231) on the opposite side from the side facing the inner layer sheet 210.

In this embodiment, the outer layer sheets 220, 230 are formed of fibers mainly consisting of thermoplastic fibers. Thermoplastic fibers forming the inner layers 222, 232 have a lower melting point than thermoplastic fibers forming the outer layers 221, 231.

The outer layers 221, 231 consist, for example, of thermoplastic fibers of polyethylene terephthalate (PET) in major proportions and the rest are rayon fibers. For example, the compounding ratio of polyethylene terephthalate (PET) fibers and rayon fibers is 80% by weight:20% by weight. Further, the polyethylene terephthalate (PET) fibers consist of those having a fineness of 1.1 dtex and those having a fineness of 3.3 at the ratio of 30% by weight:50% by weight.

As the thermoplastic fibers forming the inner layers 222, 232, polyethylene (PE) fibers/polyethylene terephthalate (PET) fibers (core-in-sheath structure) having a fineness of 2.2 dtex are used. For example, the compounding ratio of polyethylene (PE) fibers/polyethylene terephthalate (PET) fibers and rayon fibers is 70% by weight:30% by weight.

The basis weight of the outer layer sheets 220, 230 is preferably set within the range of 35 to 40 gsm from the viewpoints of the functionality, productivity, costs, etc., though, if it exceeds 30 gsm, there is no particular problem from the viewpoints of the amount of release of the cleaning solution.

By thus forming the inner layers 222, 232 of the outer layer sheets 220, 230 by using thermoplastic fibers having a lower melting point than thermoplastic fibers of the outer layers 221, 231, even if the inner layer sheet 210 contains no thermoplastic fibers, the inner layer sheet 210 and the outer layer sheets 220, 230 can be bonded together by the thermoplastic fibers having a lower melting point which are contained in the inner layer 222 of the outer layer sheet 220 and the inner layer 232 of the outer layer sheet 230.

When the outer layer sheet 220 (230) having the inner layer 222 (232) and the outer layer 221 (231) is heated at a temperature which is higher than the melting point of the thermoplastic fibers of the inner layer 222 (232) and lower than the melting point of the thermoplastic fibers of the outer layer 221 (231), a fusion bonded layer is formed in the inner layer 222 (232). As a result, most of the fibers in the inner layer 222 (232) of the outer layer sheet 220 (230) are joined together by fusion bonding, so that the amount of the cleaning solution which is released from the inner layer sheet 210 to the outer layer sheet 220 (230) is controlled.

As described above, the known cleaning sheet has a loosely entangled portion in its central portion, but each of its end portions has a substantially uniform elongation rate across its entire region. Therefore, during cleaning operation which is performed with the end portions of the cleaning sheet held by the holding members of the head of the cleaning tool, the cleaning sheet easily becomes detached from the holding members.

Therefore, in this invention, each of the ends of the cleaning sheet has a first part having a first elongation rate and a second part having an elongation rate higher than the first elongation rate. The second part is disposed on the central portion side of the first part, and a boundary between the first and second parts is formed at a position such that it can be held by the holding members 120 of the head 110 of the cleaning tool.

Figure 3:
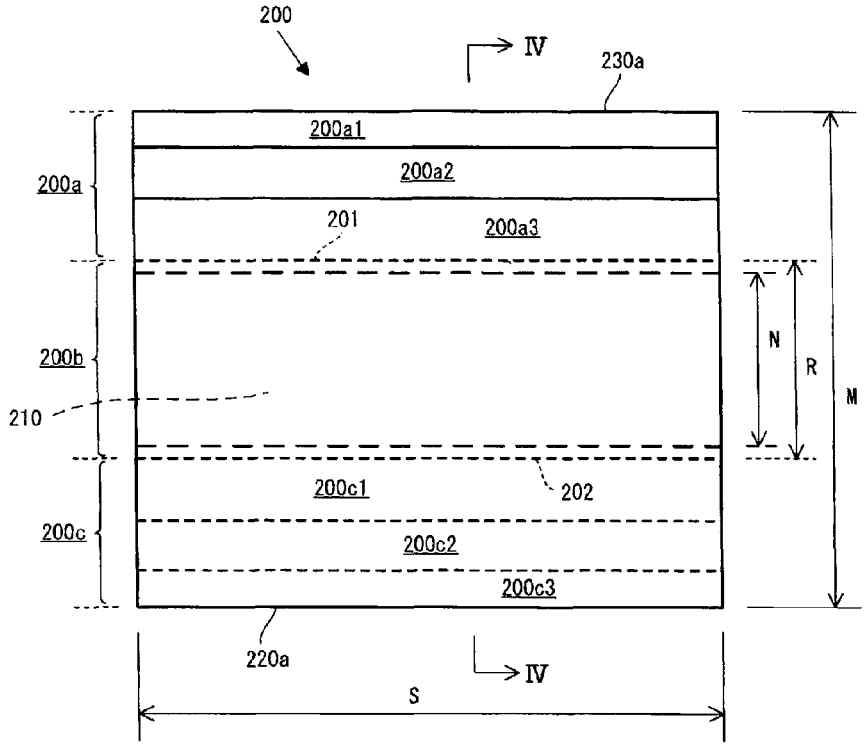
FIG. 3 shows a schematic structure of a cleaning sheet 200 according to one embodiment.

The inner layer sheet 210 and the outer layer sheets 220, 230 are arranged as shown in FIGS. 3 and 4. FIG. 4 is a sectional view taken along line IV-IV in FIG. 3.

As shown in FIG. 3, the cleaning sheet 200 has a rectangular shape having a width M (e.g. 205 mm) and a length S (e.g. 275 mm). The inner layer sheet 210 has a rectangular shape having a width N (e.g. 90 mm) and the length S. The outer layer sheets 220, 230 have a rectangular shape having a width (e.g. 190 mm) shorter than the width M and the length S.

The outer layer sheet 220 (230) has a base 220*c* (230*c*) and a folded part 220*a* (230*a*) having a predetermined fold length from its one edge in the width direction. The folded part 220*a* (230*a*) is folded over to the inner layer 222 (232) side along a folding line 220*b* (230*b*) and overlaid on part of the base 220*c* (230*c*). As shown in FIG. 4, the outer layer sheets 220, 230 having the respective folded parts 220*a*, 230*a* are arranged on the both sides of the inner layer sheet 210. At this time, the inner layer 222 of the outer layer sheet 220 and the inner layer 232 of the outer layer sheet 230 are arranged on the inner layer sheet 210 side (so as to be opposed to each other). Further, the inner layer sheet 210 is centrally located in the direction of the width M (the vertical direction as viewed in FIG. 3 and the horizontal direction as viewed in FIG. 4). The folded parts 220*a*, 230*a* of the outer layer sheets 220, 230 are arranged on the opposite sides of the inner layer sheet 210 in the width direction. Further, the folding lines 201, 202 are provided in the cleaning sheet 200 toward the center in the width direction and spaced a distance R apart from each other which is equal to or longer than the width N of the inner layer sheet 210 ($R \geq N$).

Thus, as shown in FIG. 3, the cleaning sheet 200 is divided into the centrally located central portion 200*b* and the end portions 200*a*, 200*c* provided on the both sides of the central portion 200*b* in the width direction by the folding lines 201, 202. The end portion 200*a* (200*c*) has, from one end (the other end) in the width direction, a first part 200*a*1 (200*c*1) of a two-layer structure having the folded part 220*a* (230*a*) and part of the base 220*c* (230*c*) of the outer layer sheet 220 (230), a second part 200*a*2 (200*c*2) of a single-layer structure having the base 220*c* (230*c*) of the outer layer sheet 220 (230), and a third part 200*a*3 (200*c*3) of a two-layer structure having the base 220*c* of the outer layer sheet 220 and the base 230*c* of the outer layer sheet 230. The central portion 200*b* has a three-layer structure having the base 220*c* of the outer layer sheet 220, the base 230*c* of the outer layer sheet 230 and the inner layer sheet 210.

The folding lines 201, 202 serve as guides for positioning the central portion 200*b* of the cleaning sheet 200 such that it faces the lower side (cleaning part) 111 of the head 110 when the cleaning sheet 200 is attached to the head 110 of the cleaning tool 100. A width R of the central portion 200*b* of the cleaning sheet 200 (distance between the folding lines 201, 202) is preferably equal to or longer than a width W of the lower side (cleaning part) 111 of the head 110 of the cleaning tool 100 ($R \geq W$). Further, the width N of the inner layer sheet 210 is preferably equal to or shorter than the width W of the lower side (cleaning part) 111 of the head 110 of the cleaning tool 100 ($N \leq W$). The relationship between the distance R, the width N and the width W is not limited to this.

In this embodiment, a direction (the horizontal direction as viewed in FIG. 3) along the folding lines 201, 202, 220*b*, 230*b* is referred to as the "length direction", and a direction transverse (perpendicular) to the folding lines 201, 202, 220*b*, 230*b* is referred to as the "width direction". In the case of the cleaning sheet 200 having no folding lines 201, 202, 220*b*, 230*b*, an extending direction of the end portions 200*a*, 200*c* (the horizontal direction as viewed in FIG. 3) is referred to as the "length direction", and a direction (the vertical direction as viewed in FIG. 3) transverse (perpendicular) to the extending direction of the end portions 200*a*, 200*c* is referred to as the "width direction". The "width direction" in this embodiment corresponds to the "one direction" according to this invention.

In order to fix the inner layer sheet 210 to the outer layer sheets 220, 230 in the state in which the inner layer sheet 210 and the outer layer sheets 220, 230 are arranged as shown in FIGS. 3 and 4, the inner layer sheet 210 and the outer layer sheets 220, 230 are bonded together as shown in FIGS. 5 and 6. FIG. 6 is a sectional view taken along line VI-VI in FIG. 5.

When the inner layer sheet 210 is bonded to the outer layer sheets 220, 230, the cleaning solution impregnated in the inner layer sheet 210 is released from the inner layer sheet 210 to the outer layer sheets 220, 230 via bonded portions between the inner layer sheet 210 and the outer layer sheets 220, 230. Therefore, a bonding area of bonding the inner layer sheet 210 and the outer layer sheets 220, 230 is preferably located away from the center of an area (main cleaning area) of the cleaning sheet which is used for normal cleaning operation. In other words, the bonding area is preferably located at a position such that the cleaning operation is less affected by the cleaning solution via the bonded portions. In this embodiment, the central portion 200*b* in which the inner layer sheet 210 is disposed is located to face the lower side (cleaning part) 111 of the head 110 of the cleaning tool 100, and therefore, cleaning is performed with the central portion 200*b*. Thus, the central portion 200*b* of the cleaning sheet 200 forms a "main cleaning area".

Therefore, in this embodiment, as shown in FIG. 5, the inner layer sheet 210 is bonded to the outer layer sheets 220, 230 on edges (ends) of the outer layer sheets 220, 230 in the length direction (the horizontal direction as viewed in FIG. 5). Specifically, the bonding area of bonding the inner layer sheet 210 and the outer layer sheets 220, 230 is located away from the center of an area (main cleaning area) of the cleaning sheet which is used for normal cleaning operation.

Figure 7:
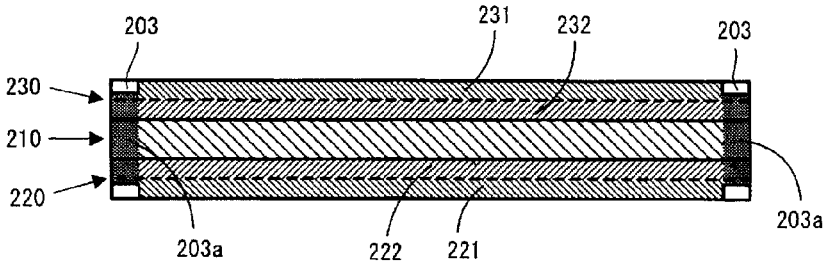
FIG. 7 is a sectional view taken along line VII-VII in FIG. 5.

Various methods can be used for such bonding. In this embodiment, a hot embossing method is used for the bonding. In FIG. 5, hot embossed portions 203 are formed on the edges of the outer layer sheets 220, 230 on the both ends in the length direction. As shown in FIG. 7, the hot embossed portions 203 and bonded portions 203*a* in which the inner layer sheet 210 is bonded to the outer layer sheets 220, 230 are formed by hot embossing the outer layer sheets 220, 230. In this embodiment, the outer layer sheets 220, 230 are formed of fibers containing thermoplastic fibers. Therefore, the inner layer sheet 210 is bonded to the outer layer sheets 220, 230 via the thermoplastic fibers forming the outer layer sheets 220, 230 (particularly, the thermoplastic fibers which have a lower melting point and are contained in the inner layer 222 of the outer layer sheet 220 and the inner layer 232 of the outer layer sheet 230) by hot embossing the outer layer sheets 220, 230.

In this specification, hot embossing for bonding the inner layer sheet 210 and the outer layer sheets 220, 230 is referred to as the "first hot embossing".

In this embodiment, it is necessary to prevent the cleaning solution impregnated in the inner layer sheet 210 from leaking out from its ends in the width direction.

Figure 8:
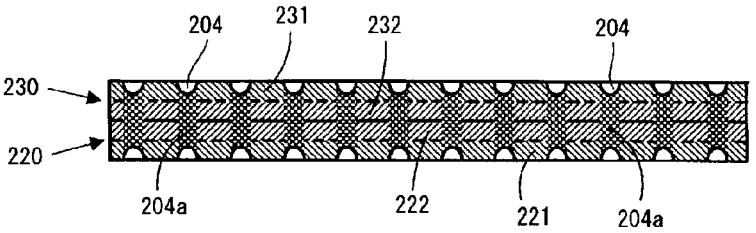
FIG. 8 is a sectional view taken along line VIII-VIII in FIG. 5.
Figure 9:
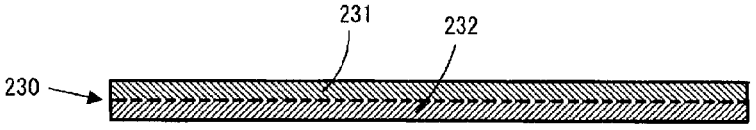
FIG. 9 is a sectional view taken along line IX-IX in FIG. 5.

In this embodiment, as shown in FIG. 6, in the third parts 200*a*3, 200*c*3 located on the both sides of the inner layer sheet 210 in the width direction, the outer layer sheets 220, 230 are bonded together. Various bonding methods can be used for bonding the outer layer sheets 220, 230. In this embodiment, the outer layer sheets are bonded together by hot embossing using a roller having depressions and projections. As shown in FIG. 8, hot embossed portions 204 and bonded portions 204*a* in which the inner layer sheet 210 is bonded to the outer layer sheets 220, 230 are formed by hot embossing the outer layer sheets 220, 230.

In this embodiment, thermoplastic fibers having a lower melting point are disposed in the outer layer sheets 220, 230. Further, the inner layer sheet 210 is not disposed in the third parts 200*a*3, 200*c*3. Therefore, in the third parts 200*a*3, 200*c*3, the outer layer sheets 220, 230 can be easily bonded together by hot embossing.

The strength of the third parts 200*a*3, 200*c*3 is increased by bonding the outer layer sheets 220, 230 by hot embossing.

In this embodiment, hot embossing for bonding the outer layer sheets 220, 230 in the third parts 200*a*3, 200*c*3 is referred to as the "second hot embossing".

In this embodiment, only the edges of the inner layer sheet 210 on the both ends in the length direction are subjected to first hot embossing, but the edges of the third parts 200*a*3, 200*c*3 on the both ends in the length direction may also be subjected to first hot embossing.

In this embodiment, in order that the first part 200*a*1 (200*c*1) has a lower elongation rate than the second part 200*a*2 (200*c*2), the folded part 220*a* and part of the base 220*c* of the outer layer sheet 220 (the folded part 230*a* and part of the base 230*c* of the outer layer sheet 230) are bonded together in the first part 200*a*1 (200*c*1). Various bonding methods can be used for bonding the folded part 220*a* and part of the base 220*c* of the outer layer sheet 220 (the folded part 230*a* and part of the base 230*c* of the outer layer sheet 230). In this embodiment, they are bonded together by hot embossing using a roller having depressions and projections.

In this embodiment, thermoplastic fibers having a lower melting point are contained in the outer layer sheet 220 (230). Further, the inner layer sheet 210 is not disposed between the folded part 220*a* and the base 220*c* of the outer layer sheet 220 (the folded part 230*a* and the base 230*c* of the outer layer sheet 230). Therefore, in the first part 200*a*1 (200*c*1), the folded part 220*a* and part of the base 220*c* of the outer layer sheet 220 (the folded part 230*a* and part of the base 230*c* of the outer layer sheet 230) can be easily bonded together by hot embossing.

By this hot embossing, the first part 200*a*1 formed by the folded part 220*a* and part of the base 220*c* of the outer layer sheet 220 and the first part 200*c*1 formed by the folded part 230*a* and part of the base 230*c* of the outer layer sheet 230 have a lower elongation rate than the second parts 200*a*2, 200*c*2. Specifically, the first parts 200*a*1, 200*c*1 are not as stretchy as the second parts 200*a*2, 200*c*2.

The elongation rate (mm/N) of the sheet is a measure of stretchiness. The higher the elongation rate, the stretchier the sheet.

In this specification, hot embossing for bonding the outer layer sheets 220, 230 in the first parts 200*a*1, 200*c*1 is referred to as the "third hot embossing".

Further, the inner layer sheet 210 is impregnated with cleaning solution. An appropriate cleaning solution by which dirt or contamination of the object to be cleaned can be removed can be used as the cleaning solution. For example, water-based cleaning solution containing alcohol, a surfactant, a solvent, an antiseptic, etc. can be used. Further, a floor protective agent, an abrasive, a freshener, perfume, etc. may be added to the cleaning solution. The amount of cleaning solution to be impregnated into the inner layer sheet 210 can be appropriately determined. For example, with respect to the weight of the yet-to-be impregnated cleaning sheet 200 (the inner layer sheet 210 and the outer layer sheets 220, 230), two to five times its volume of the cleaning solution is impregnated into the inner layer sheet 210. Various methods can be used for impregnating the cleaning solution into the inner layer sheet 210. For example, the cleaning sheet 200 may be formed by using the inner layer sheet 210 which is impregnated with the cleaning solution in advance. Alternatively, after the cleaning sheet 200 is formed, the cleaning solution may be applied to the central portion 200*b* of the outer layer sheets 220, 230 so that the inner layer sheet 210 is impregnated with the cleaning solution via the outer layer sheets 220, 230.

Figure 10:
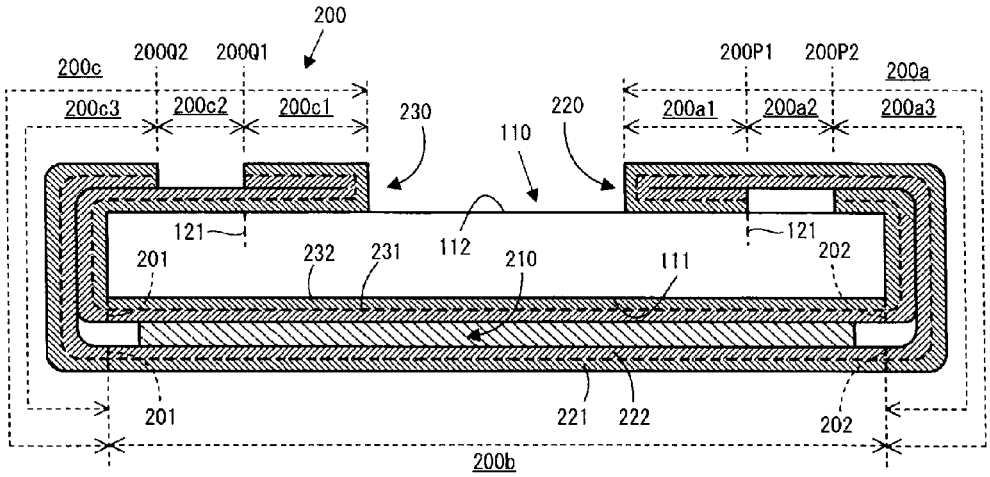
FIG. 10 is a sectional view taken along line X-X in FIG. 2.

FIG. 10 shows the cleaning sheet 200 in this embodiment which is attached to the head 110. FIG. 10 is a sectional view taken along line X-X (in the width direction) in FIG. 2.

As shown in FIG. 10, the central portion 200*b* of the cleaning sheet 200 is located to face the lower side (cleaning part) 111 of the head 110. The end portions 200*a*, 200*c* of the cleaning sheet 200 are folded over along the folding lines 201, 202 and placed on the upper side 112 of the head 110. In this embodiment, the length of the first parts 200*a*1, 200*c*1 (the length of the folded parts 220*a*, 230*a*) is set to 20 mm. Therefore, when the central portion 200*b* of the cleaning sheet 200 is placed to face the lower side (cleaning part) 111 of the head 110, and the end portions 200*a*, 200*c* are placed on the upper side 112 of the head 110, part of a boundary 200P1 between the first part 200*a*1 and the second part 200*a*2 and part of a boundary 200Q1 between the first part 200*c*1 and the second part 200*c*2 are placed to face the holding members 120 (the holding pieces 121). In this state, when the portions of the sheet facing the holding pieces 121 are pushed in through the holding pieces 121 by the fingers and then released, part of the boundary 200P1 between the first part 200*a*1 and the second part 200*a*2 and part of the boundary 200Q1 between the first part 200*c*1 and the second part 200*c*2 are caught and held between the holding pieces 121. Further, the parts of the boundary 200P1 and the boundary 200Q1 caught between the holding pieces 121 are pushed in through the holding pieces facing each other by the user's fingers (see FIG. 11). At this time, as shown in FIG. 10, the first parts 200*a*1, 200*c*1 are located inward of the second parts 200*a*2, 200*c*2 or toward the center in the width direction (on the opposite side from the central portion 200*b*) and held by the holding pieces 121.

In this embodiment, part of the boundary 200P1 (200Q1) between the first part 200*a*1 (200*c*1) having a lower elongation rate and the second part 200*a*2 (200*c*2) having a higher elongation rate is caught by the holding pieces 121 facing each other. Specifically, a point of change in the elongation rate of the sheet is held by the holding pieces 121. Therefore, even if a tensile force acts upon the cleaning sheet 200 in a direction opposite to the direction of movement of the head 110 (for example, the horizontal direction as viewed in FIG. 10) by a frictional force of an area to be cleaned during cleaning operation, the second part 200*a*2 or 200*c*2 having a higher elongation rate can effectively absorb the tensile stress, so that the end portions 200*a*, 200*c* of the cleaning sheet 200 can be prevented from becoming detached from the holding pieces 121.

Further, in order to detach the cleaning sheet 200 from the head 110, the first part 200*a*1 (200*c*1) having a lower elongation rate is pulled so that the boundary 200P1 (200Q1) can be easily pulled out through the holding pieces 121. Thus, the cleaning sheet 200 can be easily detached from the head 110.

In this embodiment, the second part 200*a*2 (200*c*2) having a higher elongation rate is designed as a single-layer structure and the first part 200*a*1 (200*c*1) having a lower elongation rate as a two-layer structure. With such a construction, the cleaning tool having the first part 200*a*1 (200*c*1) and the second part 200*a*2 (200*c*2) which are different in elongation rate can be easily manufactured at lower costs.

In this embodiment, with the construction in which the first part 200*a*1 (200*c*1) has a two-layer structure and the second part 200*a*2 (200*c*2) has a single-layer structure, the boundary 200P1 (200Q1) between the first part 200*a*1 (200*c*1) and the second part 200*a*2 (200*c*2) can be readily recognized by outward appearance, so that ease of mounting the cleaning sheet can be enhanced.

Figure 11:
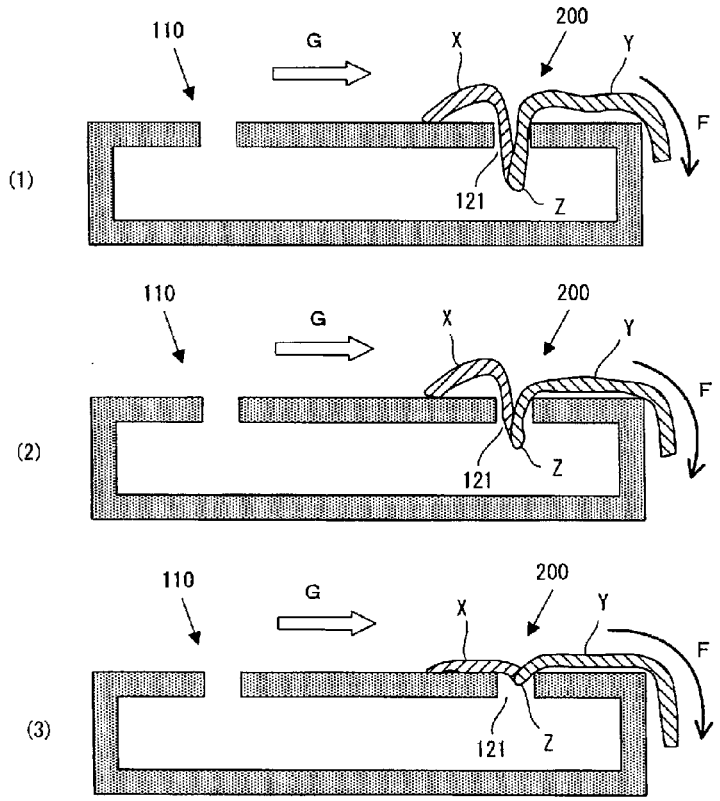
FIG. 11 is a view for illustrating operation of this invention.

Operation of this invention is conceptually explained with reference to FIG. 11. In FIG. 11, for the sake of simplicity of explanation, it is assumed that the end portion 200*a* (200*c*) of the cleaning sheet 200 has a first member X having a first elongation rate and a second member Y having a second elongation rate higher than the first elongation rate and disposed on the central portion 200*b* side of the first member X. The first member X and the second member Y substantially correspond to the above-described first part 200*a*1 (200*c*1) and the above-described second part 200*a*2 (200*c*2), respectively. Further, it is assumed that part of a boundary Z between the first member X and the second member Y is held by the holding members 120 (the holding pieces 121) of the head 110 and the head 110 is moved in a direction shown by the hollow arrow G (rightward) in FIG. 11. The boundary Z substantially corresponds to the above-described boundary 200P1 (200Q1).

When the head 110 is moved in the direction of the hollow arrow G, as shown in FIG. 11 (1), by frictional force of an area to be cleaned, a tensile stress acts in the direction of the solid arrow F upon the second member Y disposed on the end in the direction of the hollow arrow G.

In the prior art, the cleaning sheet has a loosely entangled portion in its central portion and tightly entangled portions on the both ends, but each of the end portions of the sheet has a substantially uniform elongation rate across its entire region. Therefore, the loosely entangled portion is ineffective in absorbing a tensile stress F. Thus, the sheet element held by the holding members 120 (the holding pieces 121) uniformly stretches, so that the end portion 200*a* (200*c*) of the cleaning sheet 200 easily becomes detached from the holding members 120 (the holding pieces 121).

In this embodiment, as shown in FIG. 11(2), part of the boundary Z between the first member X having a lower elongation rate and the second member Y having a higher elongation rate is held by the holding pieces 121, so that the second member Y having the higher elongation rate becomes stretchy and can effectively absorb the tensile stress. In this case, part of the boundary Z between the first member X and the second member Y is kept held by the holding pieces 121.

When the tensile stress acting upon the end portion of the cleaning sheet 200 increases, as shown in FIG. 11(3), the boundary Z between the first member X and the second member Y is pulled out through the holding pieces 121. In this case, the end portion 200*a* (200*c*) of the cleaning sheet 200 is detached from the holding pieces 121.

Further, by pulling the first member X having a lower elongation rate, the end portion 200*a* (200*c*) of the cleaning sheet 200 can be easily detached from the holding pieces 121.

Energy required for removing the cleaning sheet held by the holding pieces is measured in embodiments 1 to 4 and comparative examples 1 to 7 of the cleaning sheets of this invention. FIGS. 12 to 18 show the constructions of the cleaning sheets of embodiments 1 to 4 and comparative examples 1 to 7.

Further, in embodiments 1 to 4 and comparative examples 1 to 7, the width M is 205 mm. If the boundary Z between the first member X and the second member Y is located within the range of 20 to 40 mm from the ends (edges) in the width direction, the boundary Z between the first member X and the second member Y is placed to face the holding pieces of the head when the cleaning sheet is attached to the head.

In the following description, the "MD direction" represents the direction of the machine during manufacturing, and the "CD direction" represents a direction perpendicular to the MD direction.

Further, the "elongation rate (mm/N)" is represented as the inverse of an initial slope of a curve of [tensile stress (N)/amount of elongation (mm)] when the sheet having the width of 25 mm is pulled in a direction perpendicular to the direction of the width.

Embodiment 1

Figure 12:
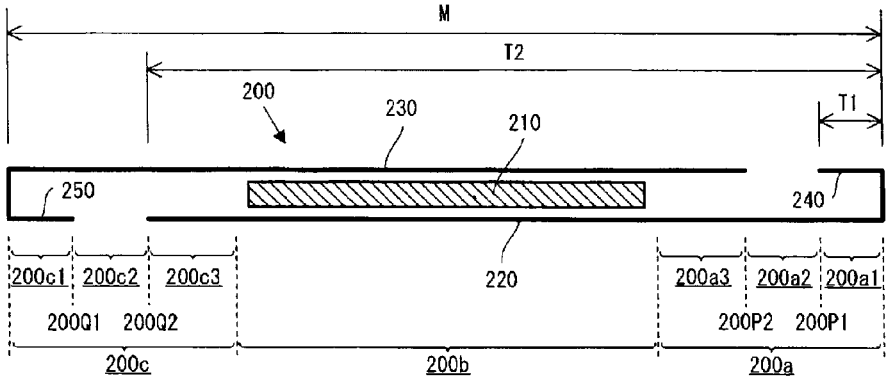
FIG. 12 shows the schematic construction of embodiment 1.

Embodiment 1 has the construction shown in FIG. 12. Each of outer layer sheets 220, 230 has a width of 190 mm and has one end in the width direction which is folded so that a folded part 240 or 250 is formed. The folded parts 240, 250 have a length T1 of 20 mm. The outer layer sheets 220, 230 are arranged on both sides of an inner layer sheet 210. In each embodiment, hot embossing is given to where it is needed, which is not particularly specified.

In embodiment 1, a first part 200*a*1 (200*c*1) or the first member X having a lower elongation rate has a two-layer structure having the outer layer sheets 220, 230. A second part 200*a*2 (200*c*2) or the second member Y having a higher elongation rate has a single-layer structure having the outer layer sheet 220 (230). Further, the CD direction of the outer layer sheets 220, 230 coincides with the width direction of the sheet (the horizontal direction in FIG. 12).

In embodiment 1, the first member X has the elongation rate of 1.00 mm/N, and the second member Y has the elongation rate of 3.30 mm/N.

Embodiment 2

Figure 13:
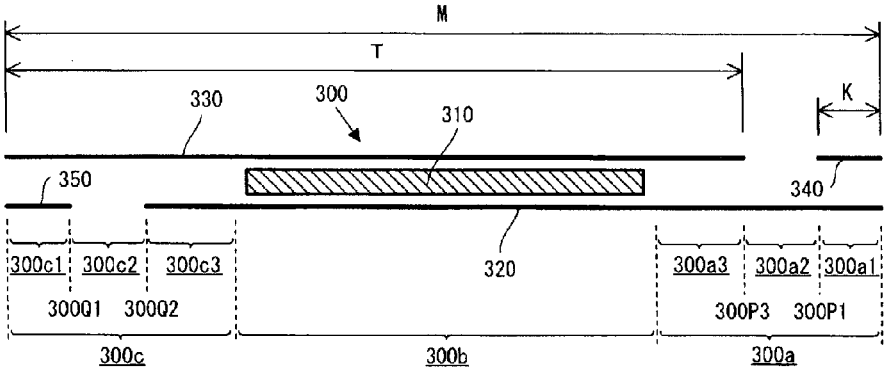
FIG. 13 shows the schematic construction of embodiments 2 and 3.

Embodiment 2 has the construction shown in FIG. 13. Each of outer layer sheets 320, 330 has a width T of 170 mm. The outer layer sheets 320, 330 are arranged on both sides of an inner layer sheet 310, and outer layer sheets 340, 350 having a width K of 20 mm are arranged on the both ends (edges) of the sheet in the width direction.

In embodiment 2, a first part 300*a*1 (300*c*1) or the first member X having a lower elongation rate has a two-layer structure having the outer layer sheets 320 (330), 340 (350). A second part 300*a*2 (300*c*2) or the second member Y having a higher elongation rate has a single-layer structure having the outer layer sheet 320 (330). Further, the CD direction of the outer layer sheets 320, 330 coincides with the width direction of the sheet (the horizontal direction in FIG. 13), and the MD direction of the outer layer sheets 340, 350 coincides with the width direction of the sheet.

In embodiment 2, the first member X has the elongation rate of 0.08 mm/N, and the second member Y has the elongation rate of 3.30 mm/N.

Embodiment 3

Embodiment 3 has the construction shown in FIG. 13. Each of the outer layer sheets 320, 330 has a width T of 170 mm. The outer layer sheets 320, 330 are arranged on the both sides of the inner layer sheet 310, and 70 g/m$^2$ spun bond nonwoven fabrics (SB) 340, 350 having a width K of 20 mm are arranged on the both ends (edges) of the sheet in the width direction.

In embodiment 3, the first part 300*a*1 (300*c*1) or the first member X having a lower elongation rate has a two-layer structure having the outer layer sheet 320 (330) and the 70 g/m$^2$ spun bond nonwoven fabric 340 (350). A second part 300*a*2 (300*c*2) or the second member Y having a higher elongation rate has a single-layer structure having the outer layer sheet 320 (330). Further, the CD direction of the outer layer sheets 320, 330 coincides with the width direction of the sheet (the horizontal direction in FIG. 13).

In embodiment 3, the first member X has the elongation rate of 0.06 mm/N, and the second member Y has the elongation rate of 3.30 mm/N.

Embodiment 4

Figure 14:
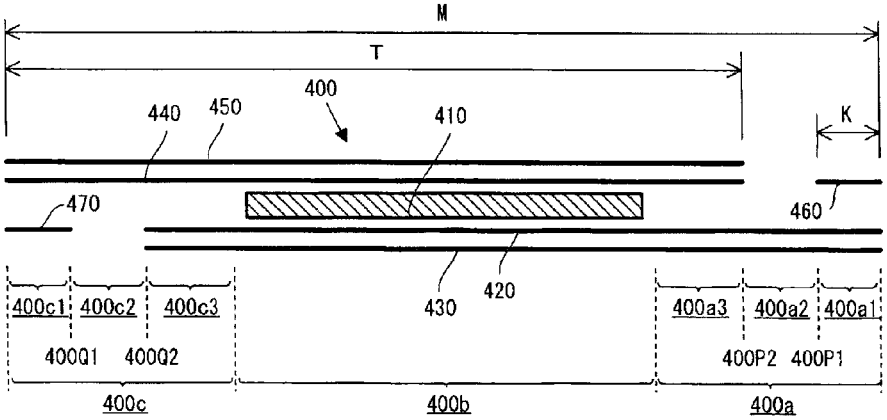
FIG. 14 shows the schematic construction of embodiment 4.

Embodiment 4 has the construction shown in FIG. 14. Each of outer layer sheets 420, 430, 440, 450 has a width T of 170 mm. The outer layer sheets 420, 430 and 440, 450 are arranged on the both sides of an inner layer sheet 410, and 70 g/m$^2$ spun bond nonwoven fabrics 460, 470 having a width K of 20 mm are arranged on the both ends (edges) of the sheet in the width direction.

In embodiment 4, a first part 400*a*1 (400*c*1) or the first member X having a lower elongation rate has a three-layer structure having the outer layer sheet 420, 430 (440, 450) and the 70 g/m$^2$ spun bond nonwoven fabric 460 (470). A second part 400*a*2 (400*c*2) or the second member Y having a higher elongation rate has a two-layer structure having the outer layer sheets 420, 430 (440, 450). Further, the CD direction of the outer layer sheets 420, 430, 440, 450 coincides with the width direction of the sheet (the horizontal direction in FIG. 14).

In embodiment 4, the first member X has the elongation rate of 0.06 mm/N, and the second member Y has the elongation rate of 1.00 mm/N.

Comparative Example 1

Figure 15:
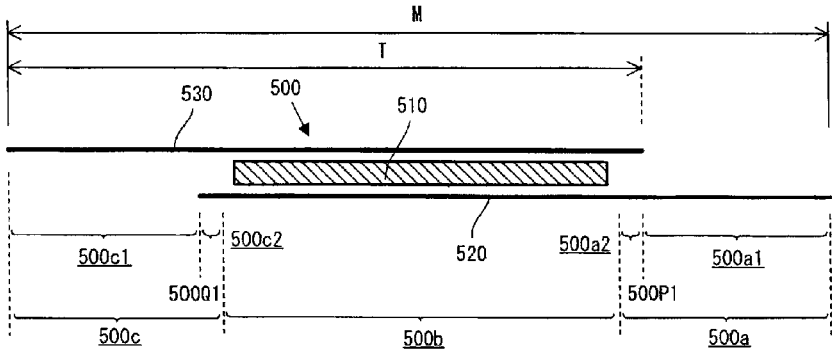
FIG. 15 shows the schematic construction of comparative example 1.

Comparative example 1 has the construction shown in FIG. 15. Each of outer layer sheets 520, 530 has a width of 150 mm. The outer layer sheets 520, 530 are arranged on both sides of an inner layer sheet 510.

In comparative example 1, a first part 500*a*1 (500*c*1) having a width of 55 mm from the end of the sheet in the width direction has a single-layer structure having the outer layer sheet 520 (530). Further, the CD direction of the outer layer sheets 520, 530 coincides with the width direction of the sheet (the horizontal direction in FIG. 15).

In comparative example 1, the first member X has the elongation rate of 3.30 mm/N, and the second member Y has the elongation rate of 3.30 mm/N.

Comparative Example 2

Figure 16:
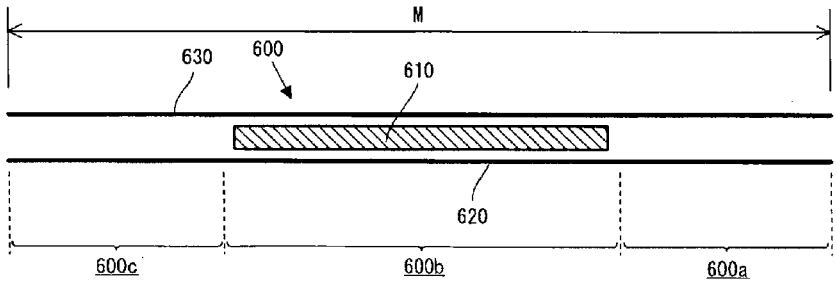
FIG. 16 shows the schematic construction of comparative examples 2 and 3.

Comparative example 2 has the construction shown in FIG. 16. Each of outer layer sheets 620, 630 has a width of 205 mm. The outer layer sheets 620, 630 are arranged on both sides of an inner layer sheet 610.

In comparative example 2, a first part 600*a* (600*c*) having a width of 55 mm from the end of the sheet in the width direction has a two-layer structure having the outer layer sheets 620, 630. Further, the CD direction of the outer layer sheets 620, 630 coincides with the width direction of the sheet (the horizontal direction in FIG. 16).

In comparative example 2, the first member X has the elongation rate of 1.00 mm/N, and the second member Y has the elongation rate of 1.00 mm/N.

Comparative Example 3

Comparative example 3 has the construction shown in FIG. 16. Each of outer layer sheets 620, 630 has a width of 205 mm. The outer layer sheets 620, 630 are arranged on both sides of an inner layer sheet 610.

In comparative example 3, a first part 600*a* (600*c*) having a width of 55 mm from the end of the sheet in the width direction has a two-layer structure having the outer layer sheets 620, 630. Further, the CD direction of the outer layer sheet 620 and the MD direction of the outer layer sheet 630 coincide with the width direction of the sheet (the horizontal direction in FIG. 16).

In comparative example 3, the first member X has the elongation rate of 0.08 mm/N, and the second member Y has the elongation rate of 0.08 mm/N.

Comparative Example 4

Figure 17:
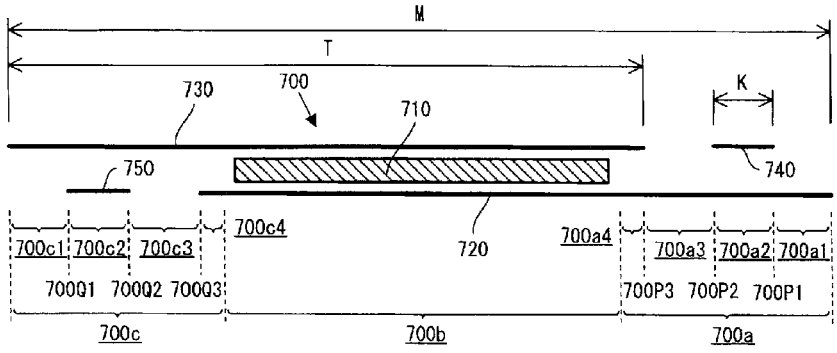
FIG. 17 shows the schematic construction of comparative examples 4 to 6.

Comparative example 4 has the construction shown in FIG. 17. Each of outer layer sheets 720, 730 has a width T of 150 mm. The outer layer sheets 720, 730 are arranged on both sides of an inner layer sheet 710. Further, outer layer sheets 740, 750 having a width K of 20 mm are arranged 20 to 40 mm away from the end of the sheet in the width direction.

In comparative example 4, a first part 700*a*1 (700*c*1) having a width of 20 mm from the end of the sheet in the width direction has a single-layer structure having the outer layer sheet 720 (730). A second part 700*a*2 (700*c*2) extending in the range of 20 to 40 mm from the end of the sheet in the width direction has a two-layer structure having the outer layer sheets 720, 740 (730, 750). Further, the CD direction of the outer layer sheets 720, 730, 740, 750 coincides with the width direction of the sheet (the horizontal direction in FIG. 17).

In comparative example 4, the first member X has the elongation rate of 3.30 mm/N, and the second member Y has the elongation rate of 1.00 mm/N.

Comparative Example 5

Comparative example 5 has the construction shown in FIG. 17. Each of outer layer sheets 720, 730 has a width T of 150 mm. The outer layer sheets 720, 730 are arranged on both sides of an inner layer sheet 710. Further, outer layer sheets 740, 750 having a width K of 20 mm are arranged 20 to 40 mm away from the end of the sheet in the width direction.

In comparative example 5, a first part 700*a*1 (700*c*1) having a width of 20 mm from the end of the sheet in the width direction has a single-layer structure having the outer layer sheet 720 (730). A second part 700*a*2 (700*c*2) extending in the range of 20 to 40 mm from the end of the sheet in the width direction has a two-layer structure having the outer layer sheets 720, 740 (730, 750). Further, the CD direction of the outer layer sheets 720, 730 and the MD direction of the outer layer sheets 740, 750 coincide with the width direction of the sheet (the horizontal direction in FIG. 17).

In comparative example 5, the first member X has the elongation rate of 3.30 mm/N, and the second member Y has the elongation rate of 0.08 mm/N.

Comparative Example 6

Comparative example 6 has the construction shown in FIG. 17. Each of outer layer sheets 720, 730 has a width T of 150 mm. The outer layer sheets 720, 730 are arranged on both sides of an inner layer sheet 710. Further, 70 g/m$^2$ spun bond nonwoven fabrics 740, 750 having a width K of 20 mm are arranged 20 to 40 mm away from the end of the sheet in the width direction.

In comparative example 6, a first part 700*a*1 (700*c*1) having a width of 20 mm from the end of the sheet in the width direction has a single-layer structure having the outer layer sheet 720 (730). A second part 700*a*2 (700*c*2) extending in the range of 20 to 40 mm from the end of the sheet in the width direction has a two-layer structure having the outer layer sheet 720 (730) and the 70 g/m$^2$ spun bond nonwoven fabric 740 (750). Further, the CD direction of the outer layer sheets 720, 730 coincide with the width direction of the sheet (the horizontal direction in FIG. 17).

In comparative example 6, the first member X has the elongation rate of 3.30 mm/N, and the second member Y has the elongation rate of 0.06 mm/N.

Comparative Example 7

Figure 18:
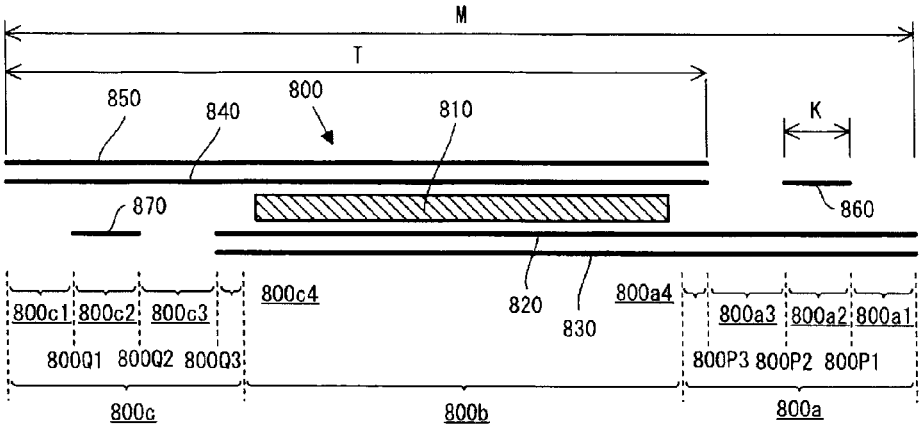
FIG. 18 shows the schematic construction of comparative example 7.

Comparative example 7 has the construction shown in FIG. 18. Each of outer layer sheets 820, 830, 840, 850 has a width T of 150 mm. The outer layer sheets 820, 830 and 840, 850 are arranged on both sides of an inner layer sheet 810. Further, 70 g/m$^2$ spun bond nonwoven fabrics 860, 870 having a width K of 20 mm are arranged 20 to 40 mm away from the end of the sheet in the width direction.

In comparative example 7, a first part 800*a*1 (800*c*1) having a width of 20 mm from the end of the sheet in the width direction has a two-layer structure having the outer layer sheets 820, 830 (840, 850). A second part 800*a*2 (800*c*2) extending in the range of 20 to 40 mm from the end of the sheet in the width direction has a three-layer structure having the outer layer sheets 820, 830 (840, 850) and the 70 g/m$^2$ spun bond nonwoven fabric 860 (870). Further, the CD direction of the outer layer sheets 820, 830, 840, 850 coincide with the width direction of the sheet (the horizontal direction in FIG. 18).

In comparative example 7, the first member X has the elongation rate of 1.00 mm/N, and the second member Y has the elongation rate of 0.06 mm/N.

Energy (J) required to remove the sheets of embodiments 1 to 4 and comparative examples 1 to 7 from the holding pieces 121 of the head 110 was measured. The measurements of energy were made as follows:

(1) Part of a specimen is pushed in through the holding pieces 121 of the fixed head. At this time, the amount of the specimen to be pushed in is adjusted to be constant by using an artificial finger.

(2) Then a predetermined point of the specimen held by the holding pieces 121 of the head is pulled. Upon removal of the specimen from the holding pieces 121, the tensile stress is measured.

(3) This measurement is made on several pieces of the same specimen.

As a result, energy of 0.09 to 0.20 J is required to remove the sheets of embodiments 1 to 4 from the holding pieces 121, while energy of 0.01 to 0.05 J is required to remove the sheets of comparative examples 1 to 7 from the holding pieces 121. In embodiments 1 to 4, it is set such that the elongation rate of the first member X is lower than the elongation rate of the second member Y. In comparative examples 1 to 3, it is set such that the elongation rate of the first member X is equal to the elongation rate of the second member Y. In comparative examples 4 to 7, it is set such that the elongation rate of the first member X is larger than the elongation rate of the second member Y.

From the measurements, it has been found that, by making the elongation rate of the first member X lower than the elongation rate of the second member Y, the cleaning sheet 200 can be effectively prevented from becoming detached from the holding pieces 121 of the head 110 during cleaning operation.

As described above, in the outer layer sheet arranged on the both sides of the inner layer sheet (impregnated element) in the cleaning sheet of this embodiment, a fusion bonded layer is formed on the side (inner side) of the outer layer sheet which faces the inner layer sheet. With this construction, the amount of the cleaning solution which is released from the impregnated element to the outer layer sheet is controlled. Therefore, during cleaning operation (when a load is put on the surface of the cleaning sheet), an appropriate amount of the cleaning solution can be released from the surface of the cleaning sheet.

Further, the inner layer sheet and the outer layer sheets are bonded at the edges of the inner layer sheet, and a space is formed between the inner layer sheet and the outer layer sheets. With this construction, the amount of the cleaning solution which is released from the inner layer sheet to the outer layer sheets via the bonded portions can be controlled.

Further, each of the ends of the cleaning sheet has a first part having a lower elongation rate and a second part having a higher elongation rate and the second part is disposed on the central portion side of the first part. The boundary between the first part and the second part is held by the holding pieces. With this construction, the ends of the cleaning sheet can be effectively prevented from becoming detached from the holding members 120 (the holding pieces 121) during cleaning operation.

In order to form a region having a higher elongation rate, in this embodiment, the layered sheet elements are bonded together by hot embossing, but a method of changing the elongation rate is not limited to this. For example, the layered sheet elements can be bonded together by using methods other than hot embossing. Further, when manufacturing a nonwoven fabric sheet (spun lace nonwoven fabric sheet) by a water jet method (hydroentangling method), the elongation rate of the particular region of the sheet may be increased by closing the nozzle in such a manner as to render the region out of reach of the water jet, or the elongation rate may be changed by changing the constitution of raw cotton.

The constructions that have been described in the above embodiment can be used singly or in combination of appropriately selected ones of them.

Further, in this embodiment, the cleaning sheet is described as a wet sheet in which the cleaning solution is impregnated in the inner layer sheet so as to be used for cleaning in a wetted state, but it may be designed as a dry sheet in which the cleaning solution is not impregnated in the inner layer sheet so as to be used for cleaning in a dry state.

The constructions of the cleaning sheet is not limited to those described in the above-described embodiment, but rather, may be added to, changed, replaced with alternatives or otherwise modified.

Further, the following features can be included in claims of the invention:

"The outer layer sheet is formed of fibers containing thermoplastic fibers, and thermoplastic fibers provided on a side of the outer layer sheet facing the inner layer sheet have a lower melting point than thermoplastic fibers provided on the side of the outer layer sheet opposite to the side facing the inner layer sheet."

"The inner layer sheet and the outer layer sheets are bonded at the edges of the outer layer sheet, and a space is formed in a central portion of the inner sheet between the inner layer sheet and the outer layer sheets."

"The inner layer sheet is centrally located in the cleaning sheet which is placed on the cleaning part (mounting side) of the cleaning sheet mounting member."

As the cleaning sheet to be used in a wetted state to clean an object, for example, a cleaning sheet having an impregnated element (e.g. inner layer sheet) impregnated with the cleaning solution, and outer layer sheets disposed on both sides of the impregnated element is used. In this case, a cleaning region (cleaning part) of the cleaning sheet which can be used to clean an object to be cleaned in an appropriate wetted state is determined by the property of releasing the cleaning solution from the outer surfaces of the outer layer sheets. Further, the property of releasing the cleaning solution from the outer surfaces of the outer layer sheets is determined by the property of releasing the cleaning solution from the impregnated element to the outer layer sheets. Further, the property of releasing the cleaning solution from the impregnated element to the outer layer sheets is determined by the amount of cleaning solution which can be impregnated into the impregnated element, or the amount of cleaning solution which is released from the impregnated element to the outer layer sheets. In order to control the amount of cleaning solution which is released from the impregnated element to the outer layer sheets, a space (clearance) may be provided between the impregnated element and the outer layer sheets, or a fusion bonded layer may be formed on the inner sides of the outer layer sheets (facing the impregnated element). In the above-described embodiment, a method for controlling the property of releasing cleaning solution from the impregnated element to the outer layer sheets is used.

The above-described cleaning sheet may also be used singly (without being mounted to the cleaning sheet mounting member of the cleaning tool) to clean an object to be cleaned. Further, the cleaning sheet or the cleaning tool of this invention can be used to clean objects having various shapes, such as planar, curved, uneven or stepped shape.

Further, the cleaning sheet may also be designed to be used in a dry state to clean an object to be cleaned.

DESCRIPTION OF NUMERALS

100 cleaning tool
110 head (cleaning sheet mounting member)
120 holding member
121 holding piece
130 pipe
131 connecting mechanism
150 handle
200, 300, 400, 500, 600, 700, 800 cleaning sheet
200*a*, 200*c*, 300*a*, 300*c*, 400*a*, 400*c*, 500*a*, 500*c*, 600*a*, 600*c*, 700*a*, 700*c*, 800*a*, 800*c* end portion
200*a*1, 200*c*1 first part
200*a*2, 200*c*2 second part
200*a*3, 200*c*3 third part
200P1, 200Q1 first boundary
200P2, 200Q2 second boundary
200*b*, 300*b*, 400*b*, 500*b*, 600*b*, 700*b*, 800*b* central portion (cleaning part)
201, 202, 220*b*, 230*b* folding line
220*a*, 230*a* folded part
210, 310, 410, 510, 610, 710, 810 inner layer sheet
220, 230, 320, 330, 420, 430, 520, 530, 620, 630, 720, 730, 820, 830 outer layer sheet
221, 231 outer layer
222, 232 inner layer (fusion bonded layer)
203, 204 hot embossed portion

The invention claimed is:

1. A cleaning sheet attachable to a cleaning sheet mounting member comprising:
- a central portion forming a cleaning side and
- at least one end portion formed on at least one side of the central portion along one predetermined direction, wherein:
- the end portion has a first part having a first elongation rate and a second part having an elongation rate higher than the first elongation rate and formed between the first part and the central portion along the one direction, and
- a boundary between the first and second parts is removably heldable by the cleaning sheet mounting member,
- wherein the second part has a higher elongation rate than the first part by changing an entangled state of fibers in each of the first and second parts.

2. The cleaning sheet as defined in claim 1, wherein the second part is formed by a single sheet element or by a plurality of sheet elements layered and bonded together, and the first part is formed by a larger number of thicknesses of sheet elements bonded together than the sheet elements of the second part, so that the second part has a higher elongation rate than the first part.

3. The cleaning sheet as defined in claim 2, wherein the layered sheet elements of the first part are bonded together by embossing.

4. The cleaning sheet as defined in claim 1, wherein the at least one end portion has a third part having a lower elongation rate than the second part and formed between the second part and the central portion along the one direction.

5. A cleaning tool having the cleaning sheet as defined in claim 1 and a cleaning sheet mounting member, wherein:
- the cleaning sheet mounting member has a cleaning part and a holding member, and
- when the cleaning sheet is attached to the cleaning sheet mounting member, a central portion of the cleaning sheet is placed on the cleaning part and the boundary is removably held by the holding member.

6. The cleaning tool as defined in claim 5, wherein the holding member has a plurality of elastic holding pieces which are opposed to each other, and the boundary of the cleaning sheet is pushed in through the holding member between the holding pieces and caught by the holding pieces, so that the boundary is held by the holding member.

7. A cleaning sheet attachable to a cleaning sheet mounting member comprising:
- a central portion forming a cleaning side and
- at least one end portion formed on at least one side of the central portion along one predetermined direction, wherein:
- the end portion has a first part having a first elongation rate and a second part having an elongation rate higher than the first elongation rate and formed between the first part and the central portion along the one direction, and
- a boundary between the first and second parts is removably heldable by the cleaning sheet mounting member, wherein the second part has a higher elongation rate than the first part changing the constitution of raw cotton in each of the first and second parts.

8. The cleaning sheet as defined in claim 7, wherein the second part is formed by a single sheet element or by a plurality of sheet elements layered and bonded together, and the first part is formed by a larger number of thicknesses of sheet elements bonded together than the sheet elements of the second part, so that the second part has a higher elongation rate than the first part.

9. The cleaning sheet as defined in claim 8, wherein the layered sheet elements of the first part are bonded together by embossing.

10. The cleaning sheet as defined in claim 7, wherein the at least one end portion has a third part having a lower elongation rate than the second part and formed between the second part and the central portion along the one direction.

11. A cleaning tool having the cleaning sheet as defined in claim 7 and a cleaning sheet mounting member, wherein:

the cleaning sheet mounting member has a cleaning part and a holding member, and when the cleaning sheet is attached to the cleaning sheet mounting member, a central portion of the cleaning sheet is placed on the cleaning part and the boundary is removably held by the holding member.

12. The cleaning tool as defined in claim 11, wherein the holding member has a plurality of elastic holding pieces which are opposed to each other, and the boundary of the cleaning sheet is pushed in through the holding member between the holding pieces and caught by the holding pieces, so that the boundary is held by the holding member.

* * * * *